US006265972B1

(12) United States Patent
Lee

(10) Patent No.: US 6,265,972 B1
(45) Date of Patent: Jul. 24, 2001

(54) PET RESISTANT PIR DETECTOR

(75) Inventor: Steven Lee, Toronto (CA)

(73) Assignee: Digital Security Controls Ltd., Concord ( * ) Notice: Subject to any disclaimer, the term of this patent is extended or adjusted under 35 U.S.C. 154(b) by 0 days.

(21) Appl. No.: 09/570,815

(22) Filed: May 15, 2000

(51) Int. Cl.[7] ..... G08B 13/00

(52) U.S. Cl. ..... 340/541; 340/545.3; 340/567; 250/342; 250/353

(58) Field of Search ..... 340/541, 567; 250/342, 353; 348/143

(56) References Cited

U.S. PATENT DOCUMENTS 3,703,718 * 11/1972 Berman ..... 340/258 D
4,263,585 * 4/1981 Schaefer ..... 340/567
4,849,635 * 7/1989 Sugimoto ..... 250/342
4,990,783 * 2/1991 Muller et al. ..... 250/353
5,670,943 * 9/1997 Dipoala et al. ..... 340/567
5,923,250 * 7/1999 Pildner et al. ..... 340/567
5,936,666 * 8/1999 Davis ..... 348/143

* cited by examiner

*Primary Examiner*—Jeffery Hofsass
*Assistant Examiner*—Phung T. Nguyen

(57) ABSTRACT

A passive infrared sensor uses a modified lens or mirror to vertically elongate the detection zones in regions close to the sensor. This vertical elongation reduces the signal produced by a small pet, such as a cat, while the greater height of a human intruder produces a larger signal. The sensor advantageously uses a single detector and the same algorithm is used to distinguish human intruders from small pets

17 Claims, 8 Drawing Sheets

PET RESISTANT PIR DETECTOR

BACKGROUND OF THE INVENTION

The present application relates to passive infrared motion detection sensors and in particular, relates to a sensor which has improved features with respect to false alarms caused by small pets.

Passive infrared detectors focus radiation from an area to be monitored in a particular manner such that movement of a human intruder through the monitored space is detected. A Fresnel focussing arrangement (lens or mirror) focuses infrared radiation emitted by a human or pet target onto a passive infrared detector. To improve the response characteristics of the sensor, the Fresnel lens has multiple lensets and each lenset includes a focussing element defining an infrared beam that collectively covers the protected area. These beams increase in size as an increasing function of proportional to the distance from the detector. This characteristic of the Fresnel lens makes it difficult to distinguish between small pets located in a region close to the detector from a human target located at a substantial distance from the detector. In the closer region to the detector, the beams are quite small, and as such, a small pet will produce a signal similar in level to a person a substantial distance away from the detector.

As can be appreciated, small pets and in particular, cats, have substantial vertical mobility and are not confined to an area adjacent the floor. Some systems have attempted to design a dead or reduced bottom zone in the region close to the sensor in order to reduce problems associated with false alarms, caused by pets. The substantial vertical mobility of cats defeats this type of system.

U.S. Pat. No. 4,849,635 discloses a single passive infrared detector sensor where substantial gaps are provided between the sensing beams or zones. These zones are spaced such that a small pet must enter a dead zone as they move across the space. In contrast, a human target is much larger and taller and will therefore, produce a signal regardless whether he is standing at a position which at floor lever, is in a dead zone. With this arrangement, a pet produces a pulse signal with a very low component when the pet is in the dead zone, whereas a human target, although producing a pulsed signal, the signal is much more constant and can be easily distinguished from a pet. Unfortunately, with this system, a cat located at a high point in close proximity to the sensor will bridge two active zones much in the manner of a human.

It has also been known to use two different types of sensors to help distinguish between a human intruder and a pet. In particular, a microwave sensor in combination with a passive infrared sensor has been used. This type of dual technology sensor greatly increases the cost of the system and as such, is not particularly desirable. It has also been proposed to use a two element passive infrared detector and analyze the signal from the two detectors to distinguish between an intruder and a pet. Typically one element receives low radiation and one detector receives high radiation. S small pet does not have the height to trigger both detectors. This system again experiences some difficulties and also has the additional cost of the two element detection.

A better approach for distinguishing between small pets and human intruders is needed.

SUMMARY OF THE INVENTION

A passive infrared motion sensor according to the present invention comprises a passive infrared detector, a Fresnel focussing arrangement in front of the detector for selective focussing of infrared radiation from an area to be monitored, and directing such radiation onto the detector and processing such circuitry for analyzing the signal from the detector and making a determination whether an intruder is present.

The Fresnel focussing arrangement is divided into at least two tiers comprising a first tier and a second tier. The first tier focusses radiation from a distant subdivision of the area being monitored and the second tier focusses radiation from a close subdivision of the area being monitored.

The second tier divides the close subdivision into narrow elongated vertically disposed sensing strips such that a pet in the close subdivision causes the detector to produce a signal less than 80% of the signal used to indicate the presence of an intruder in the close subdivision or the distant subdivision.

The Fresnel focussing arrangement can either be a mirror arrangement or a lens arrangement. Preferably, a Fresnel lens is used, comprising a number of stacked lensets of a Fresnel lens with the result being an elongation of the area which is capable of receiving radiation focussing the same on the detector. Basically, the lensets stacked one on top of the other, provides a series of vertical focal points in contrast to the prior practice of a single focal point. With this arrangement, what was previously a very small responsive area in close proximity to the sensor has now been elongated or shaped, whereby the radiation from a pet in close proximity is in proportion to the radiation received from a human intruder at a substantial distance from the sensor (i.e., it is substantially smaller in magnitude).

Basically the size of the active area has been elongated and in most cases, narrowe. With this arrangement, a small pet tends to traverse across this area while an intruder still has substantial vertical height, and as such, will trip the system. Thus, the system enlarges the sensing area and decreases the response caused by a small pet.

A passive infrared motion sensor according to an aspect of the invention, comprises a passive infrared detector, a Fresnel lens focussing arrangement in front of the detector for segmented focussing of infrared radiation from an area to be monitored onto the detector and processing circuitry for analyzing the detector, and making a determination whether an intruder is present.

The Fresnel focussing arrangement is divided into at least three horizontal tiers comprising an upper distant tier, an intermediate tier and a close tier, with each tier having a series of horizontally spaced focussing facets. Each focussing facet of the close and the intermediate tiers are segmented to vertically elongate and shape a detection region of the facet such that the passive infrared radiation received due to a small pet in the detection region is easily distinguished from passive infrared radiation received due to an intruder in the detection region.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
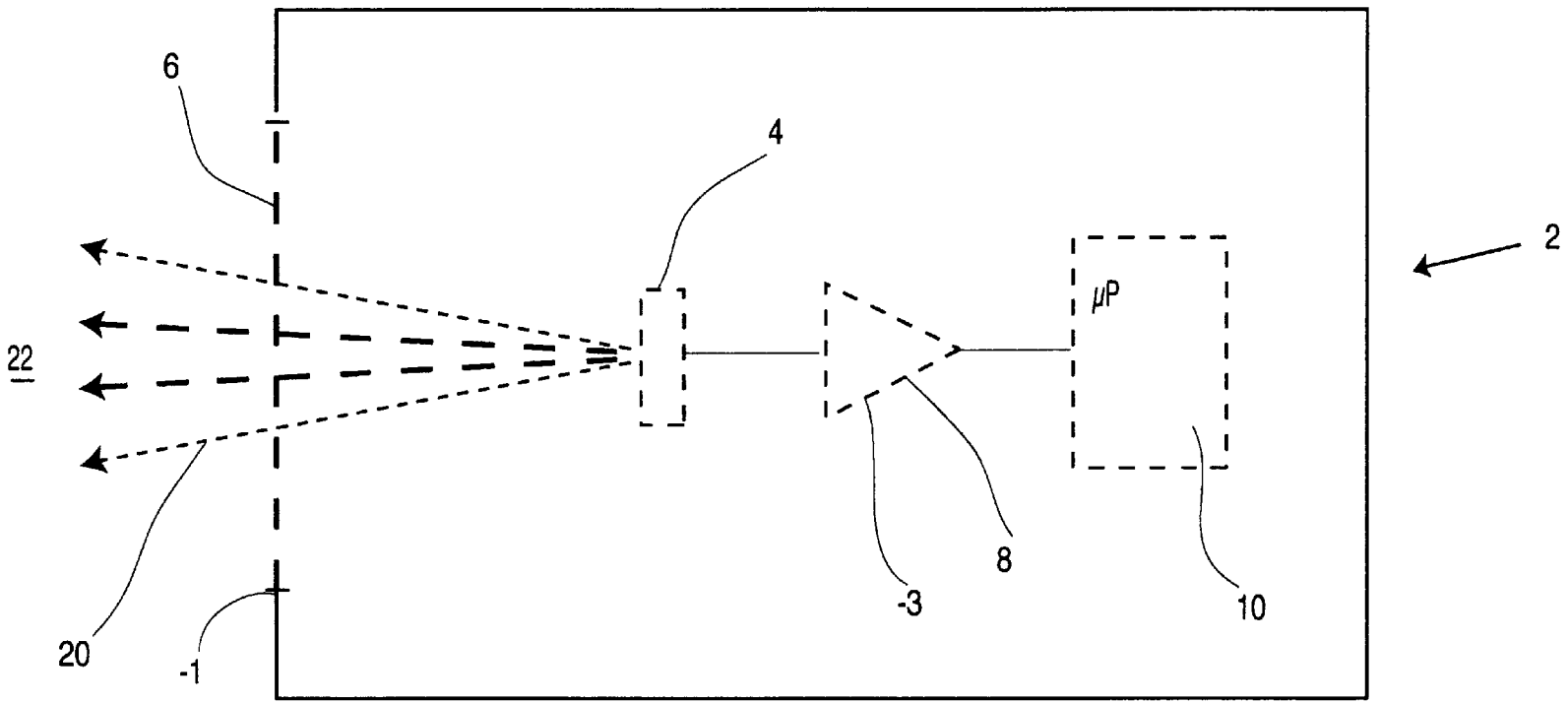
FIG. 1 is a schematic of the passive infrared motion sensor.

The passive infrared motion sensor 2 comprises a single element detector 4, a Fresnel focussing arrangement 6, and in this case a lens which focusses the infrared radiation 20 from the space being monitored 22 onto the detector. The signal from the single element detector 4 is fed to the signal conditioning and amplification block 3 with the conditioned signal being provided to the microprocessor 10. The microprocessor 10 determines the strength of the signal received at any point in time and based thereon, determines alarm conditions.

The signal that is generated by a small pet is normally significantly lower in amplitude than a human and can be screened by an appropriate algorithm. Unfortunately, as shown in FIG. 2, the Fresnel lens arrangement which are used in prior art passive infrared motion sensors have the characteristic that the size of the active area from which radiation is focussed increases as a function of the separation distance from the detector.

Figure 2:
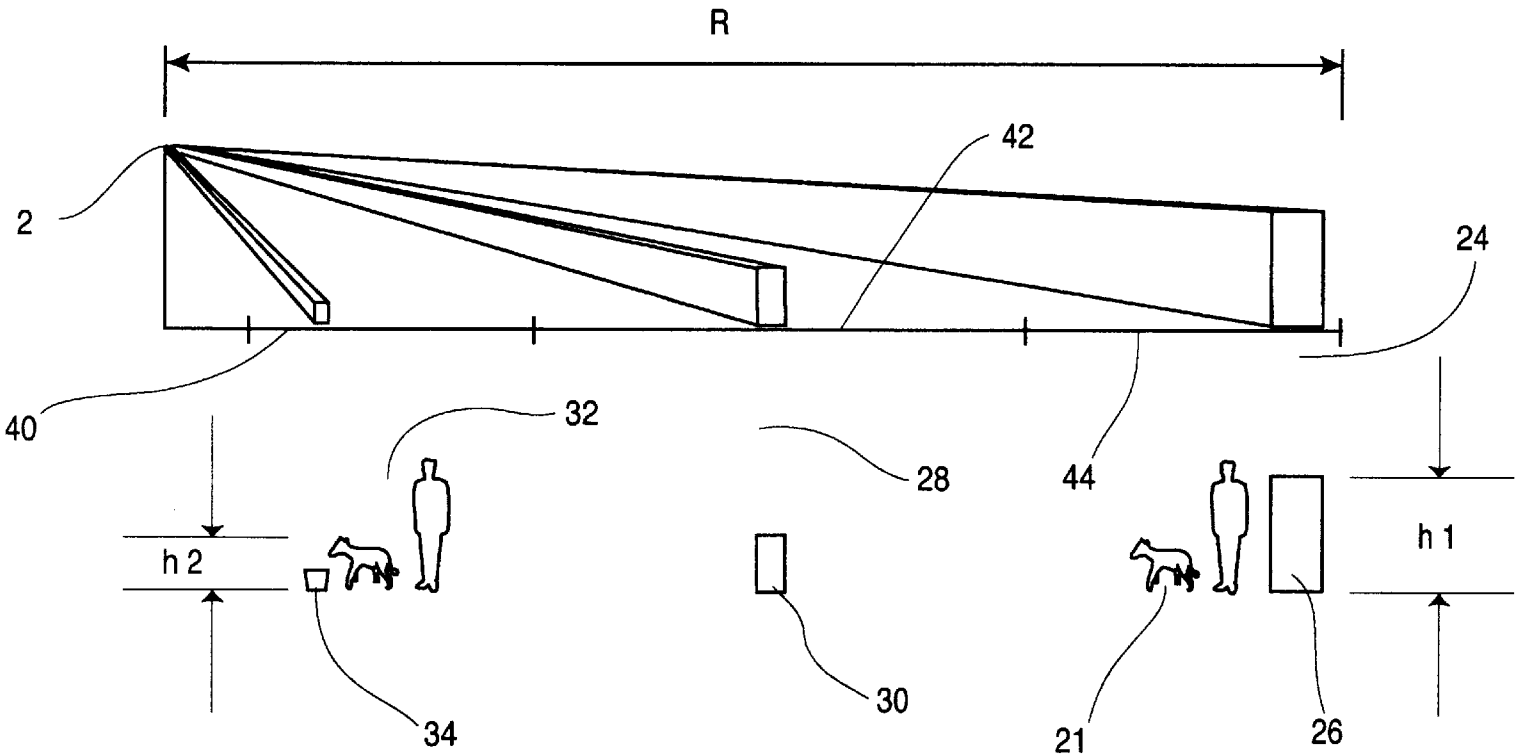
Figure 2 ( Prior Art )
FIG. 2 is a schematic showing the sensing conditions of a conventional passive infrared sensor.

As shown in FIG. 2, the distant zone 44 has an active area generally indicated as 26 and this area can be sized to allow the radiation from a human to effectively be recognized by the sensor. A small pet 21 in the active area 26 does not produce a signal of sufficient magnitude to indicate an alarm condition. In the intermediate zone 42 the active area 30 is smaller in size as the distance from the detector has decreased. Once again, the pet does not occupy all of the active area 30 and the active area 30 will cover a large portion of a human intruder, and as such, a pet and a human can be distinguished.

In the close area indicated as 40, the active area has substantially decreased as indicated by 34 and a small pet such as a cat, will be of a height of approximately H2 and effectively covers the area 34. Unfortunately, the signal produced by the pet will be of a magnitude similar to the signal produced by a human in area 26. This close region of the sensor is the area where it has been very difficult to distinguish small pets from human intruders at a long distance. It could also be viewed that the pet and the human, due to the limited size of the region 34 produce a similar signal which would not be the case with respect to active area 30 or active area 26.

Figure 3:
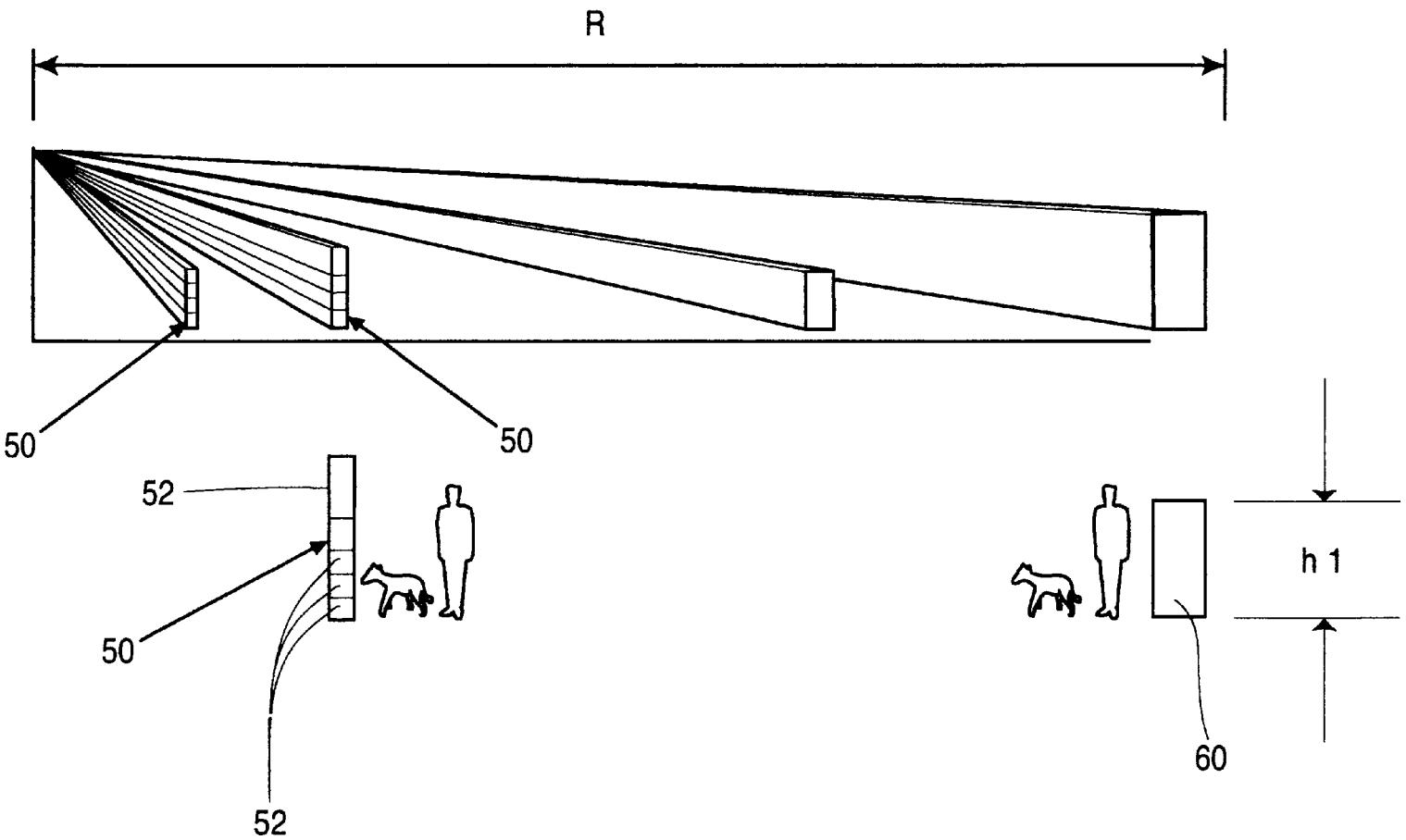
FIG. 3 is a schematic illustrating vertical elongation of the sensing regions being used within a close and intermediate zone.

FIG. 3 shows the results of a modified Fresnel lens arrangement where the active areas of the sensor in a region close to the sensor have been vertically elongated and reduced in width. The vertical elongation 50 shows a number of segments 52 which increase in size vertically. With this vertical shaping of the active zone, the lower most segment 52 again is dominated by a small pet when the pet crosses that zone, however, the magnitude of that signal has been reduced and the amount of radiation received by the detector has been reduced by the extent that the zone has been vertically elongated due to the stack of the focussing segments 52. Thus it can be seen that a human intruder, relative to the active zone 60 will produce a signal that is very similar to an intruder passing through the active zone 50 as he approaches the detector. Similarly the signal from the pet in zone 50 will be in proportion and will certainly not exceed the signal produced by a human at 60. This vertical elongation of the active zones close to the sensor is particularly advantageous as the single element detector 4 can be used and a small pet easily distinguished.

Figure 4:
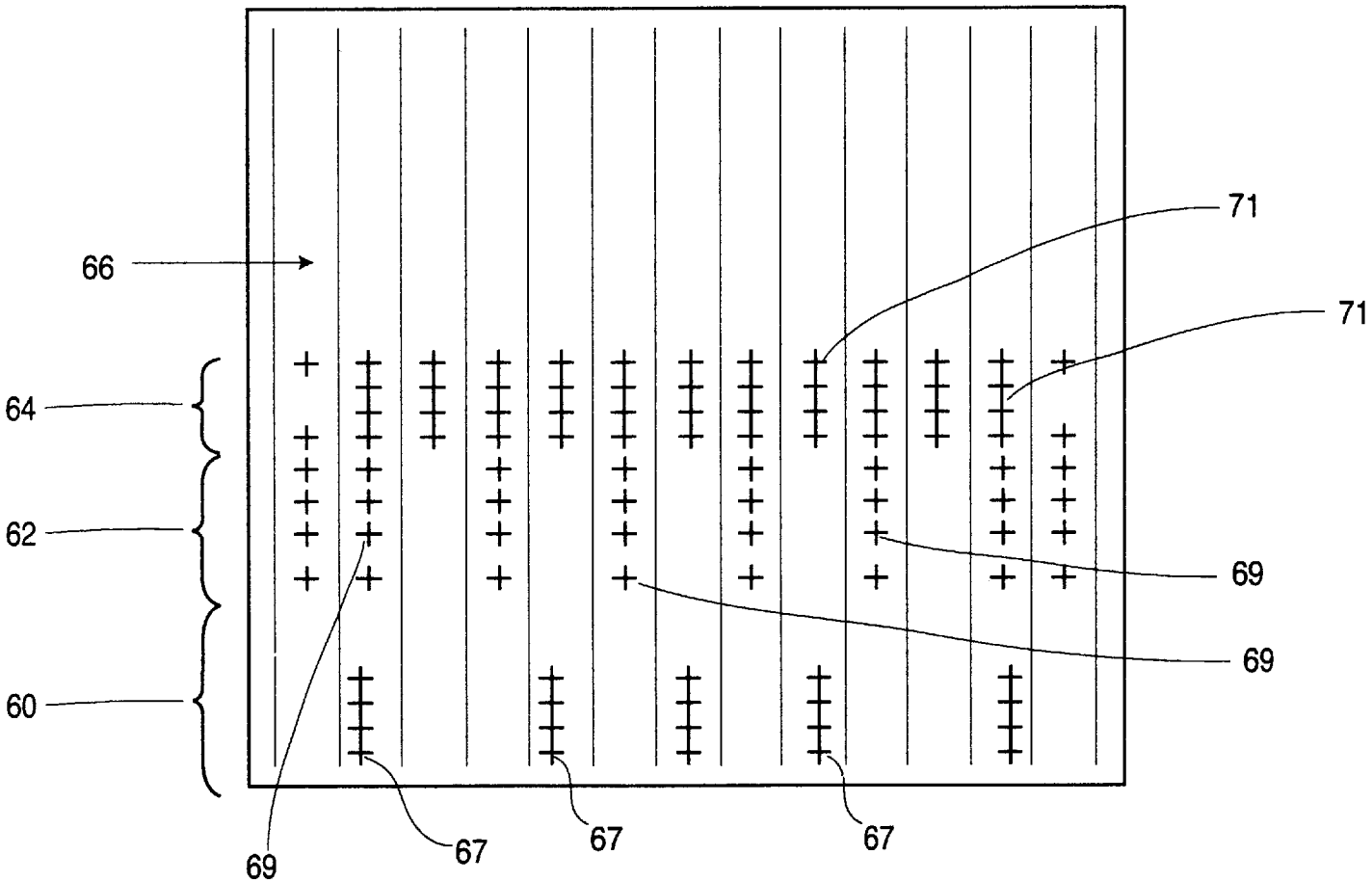
FIG. 4 shows a Fresnel lens arrangement divided into a series of zones and showing the location of the various focal points.

This vertical elongation of the active zones close to the sensor can be partially explained with respect to FIG. 4 The Fresnel lens arrangement has been divided into four divisions, namely; tier 1—60, tier 2—62, tier 3—64 and the upper region 66. Upper region 66 is a typical Fresnel lens arrangement for monitoring a distant region from the detector. Tiers 1, 2 and 3 are for the area closer to the sensor.

Tier 1 shows the vertical stacked focal points 67 of each lens sublet and in this case, five stacks of focal points 67 are shown. The second tier —62, again has a modified series of lensets having focal points 69 which are again vertically stacked. These focal points 69 are offset relative to the focal points 67 and cooperate with tier 1 to define the close region. They require a second tier due to the different structures of tier 1 and 2 which will be explained with reference to FIGS. 6 through 8. Tier 3 also has a series of stacked focal points 71 and these are used for the intermediate region. As previously mentioned, the region 66 is for the distant region and is of a conventional design.

Figure 5:
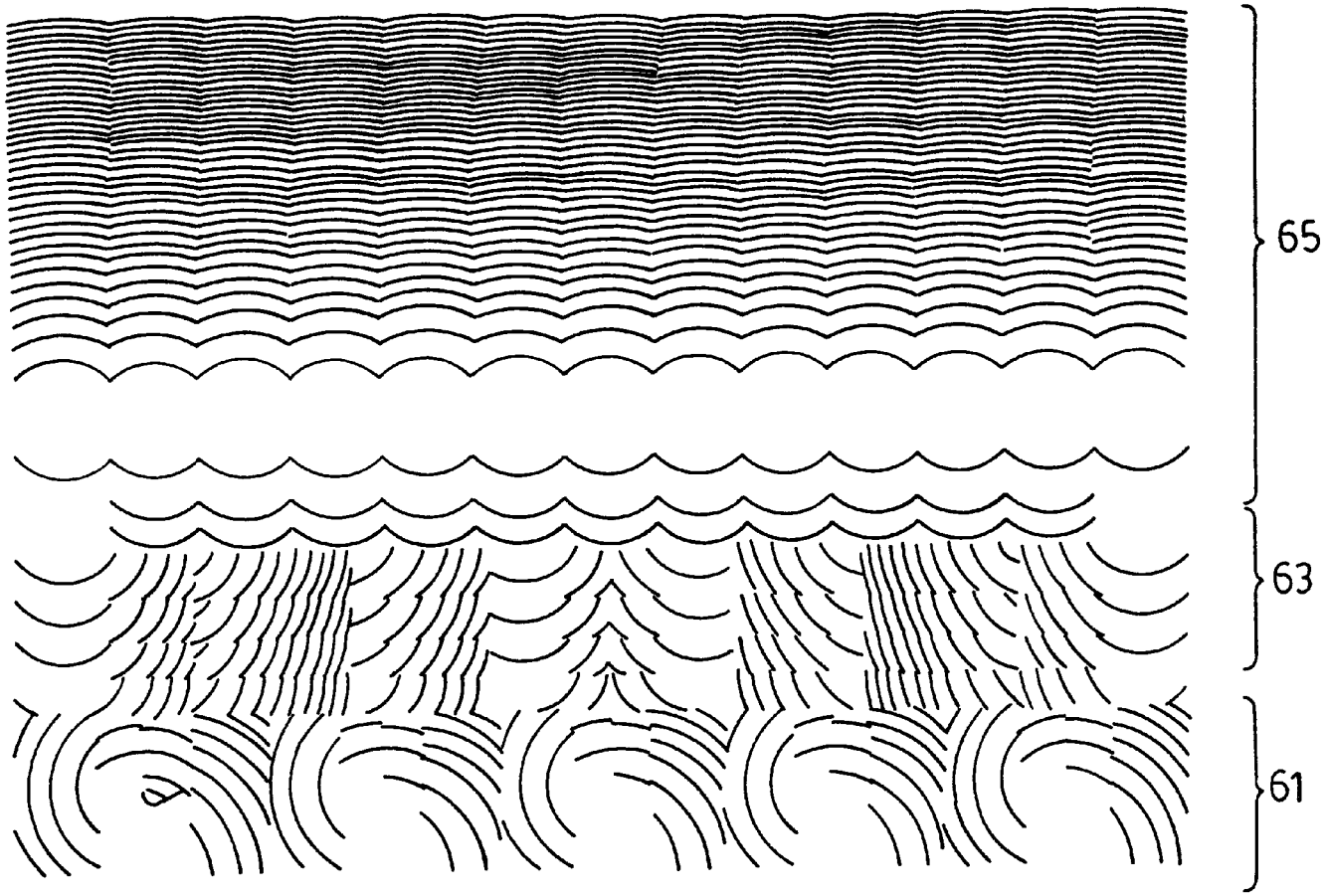
FIG. 5 shows a Fresnel lens similar to the lens of FIG. 4, however, showing the actual shape of the lens.
Figure 7:
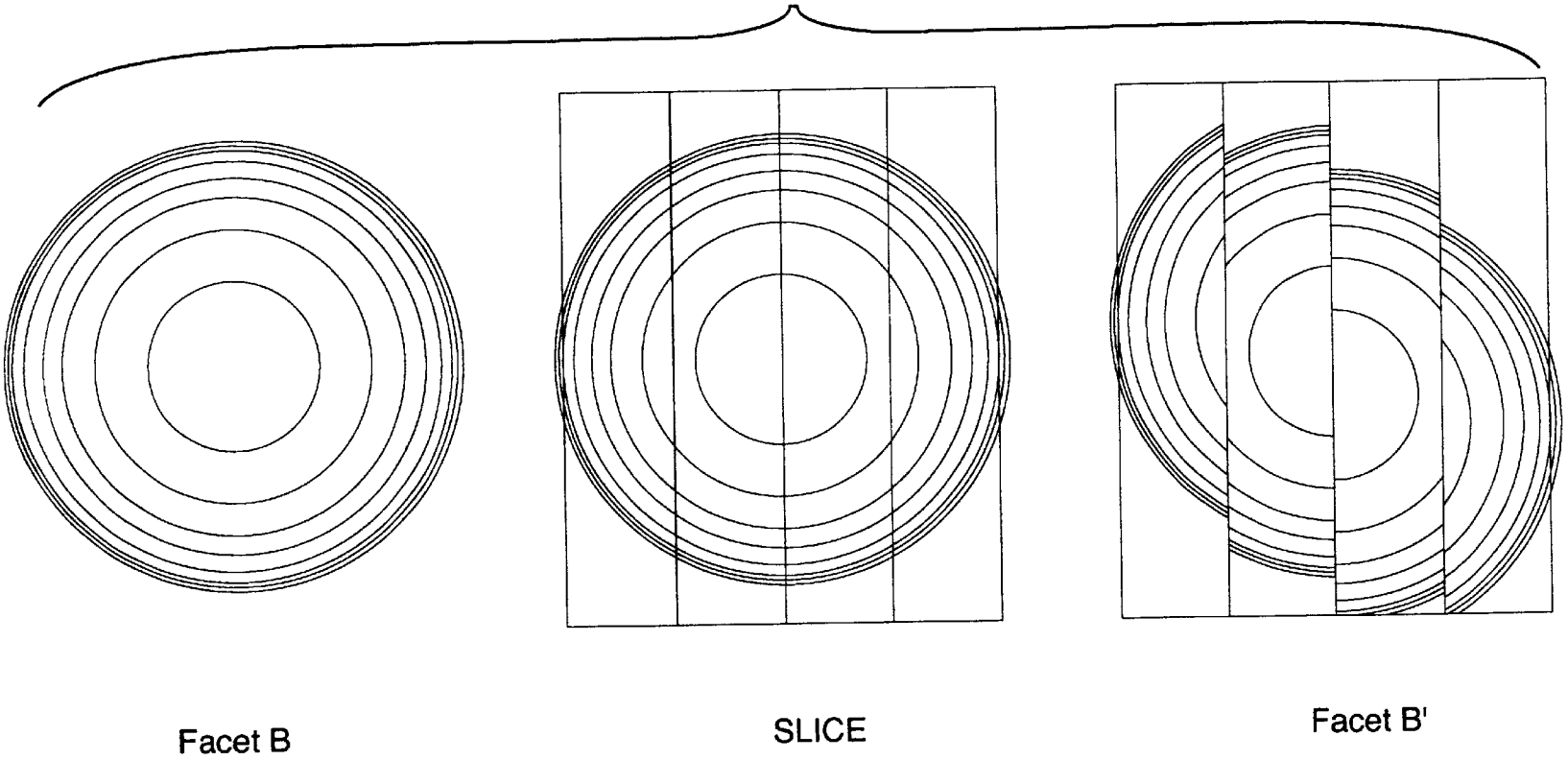
FIG. 7 illustrates the formation of a modified facet of the Fresnel lens.

FIG. 5 shows a Fresnel lens arrangement divided into regions 61, 63 and 65. Region 61 is produced by slicing of a Fresnel lens facet as shown in FIG. 7. The facet B of FIG. 7 is essentially vertically sliced as shown in the intermediate drawing. It is then vertically displaced as shown by fact B' of FIG. 7. This vertical displacement stack of focal points 67 shown in FIG. 4. This approach vertically elongates the active zone and thus shapes the reactive zone in the desired manner to increase the vertical sensitivity and reduce the signal that a small pet will produce if it crosses this active zone.

Figure 6:
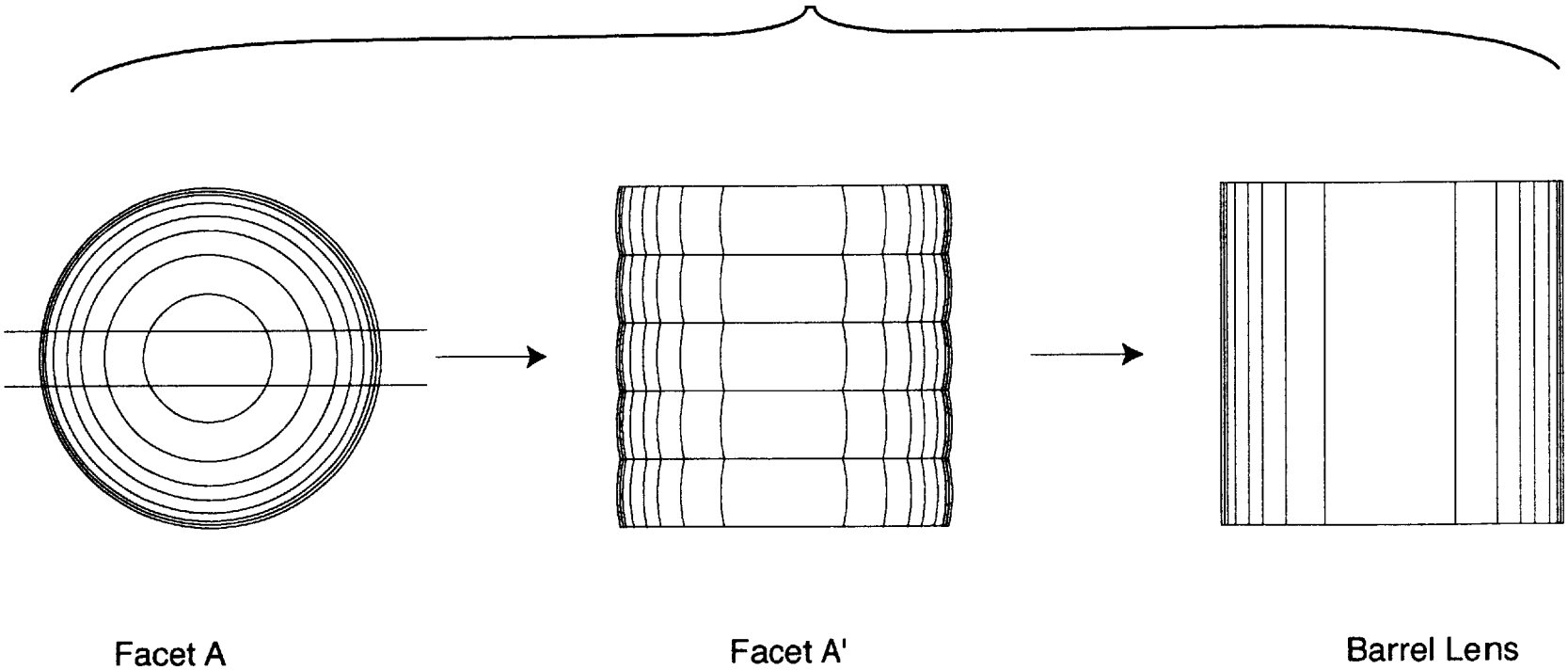
FIG. 6 illustrates the formation of a segmented facet portions of a Fresnel lens are produced.

Tier 63 of FIG. 5 is produced in the manner shown in FIG. 6. A central portion of facet A of FIG. 6 is removed and similar facets are stacked one above the other to produce the facet A' of FIG. 6. This is the general structure of the various segments 63. If the portions are small enough, the resulting stack can approach the barrel type lens of FIG. 6. It can also be seen in FIG. 5 that the segment 63 has four such stacked segments one above the other and there are different portions horizontally across the Fresnel lens.

With this arrangement, the active area close to the sensor has been vertically elongated and is relatively narrow. By increasing the vertical extent of the active area, the signal produced by a small pet is greatly reduced and thus the sensitivity to small pets is greatly reduced. The vertical elongation assures that the taller human intruder will be sensed, therefore, the vertical elongation in the close zone allows decreasing of the signal caused by a small pet, and allows this reduced signal to be distinguished from an intruder at a substantial distance from the sensor.

With this arrangement, a single element detector can be used and the same algorithm is used by the microprocessor to distinguish between humans and small pets easily distinguishes pets. If a cat happens to climb up onto a couch and moves along the back of the couch in close proximity to the sensor, the small pet will still not occupy all of the segmented active zone due to the substantial vertical elongation and as such, the resulting signal is less than that used to distinguish an intruder.

The focussing arrangement vertical elongates the responsive area. This vertical elongation can be achieved through appropriate lens design or mirror design. The Fresnel lens is one convenient approach to achieve this result. A mirror for focussing of the infrared radiation is a cost effective alternative. The mirror can be segmented or of a continuous design to achieve the desired vertical elongation to allow a small pet and a human intruder to be distinguished.

Some PIR motion detectors utilize mirror optics to focus the infrared energy from the protected area. Normally, the mirror focussing arrangement has better efficiency in focussing compared to the Fresnel lens. A curved mirror acts as a concentrator of energy and also creates beam patterns similar to a Fresnel lens. A given mirror surface can be segmented and each segment rotated by small increments to elongate the beam pattern. Another way of achieving a similar result is to modify the curvature of the mirror to widen the beam pattern. The reflection of incident infrared ray is dependent on the angle of incidence. The curvature of the mirror can be designed to create desirable beam width and length at given distances from the detector.

This elongation or shaping technique is also able to distinguish two pets in close proximity to the sensor. Basically, the signal produced by a small pet such as a cat, is less than about 40% of two cats in close proximity to the sensor will only produce a signal at about 80% of the magnitude necessary to indicate an intruder.

This technique of vertical elongation to distinguish between small pets and intruders is particularly helpful in an area immediately below the detector as well as an intermediate area.

Figure 8:
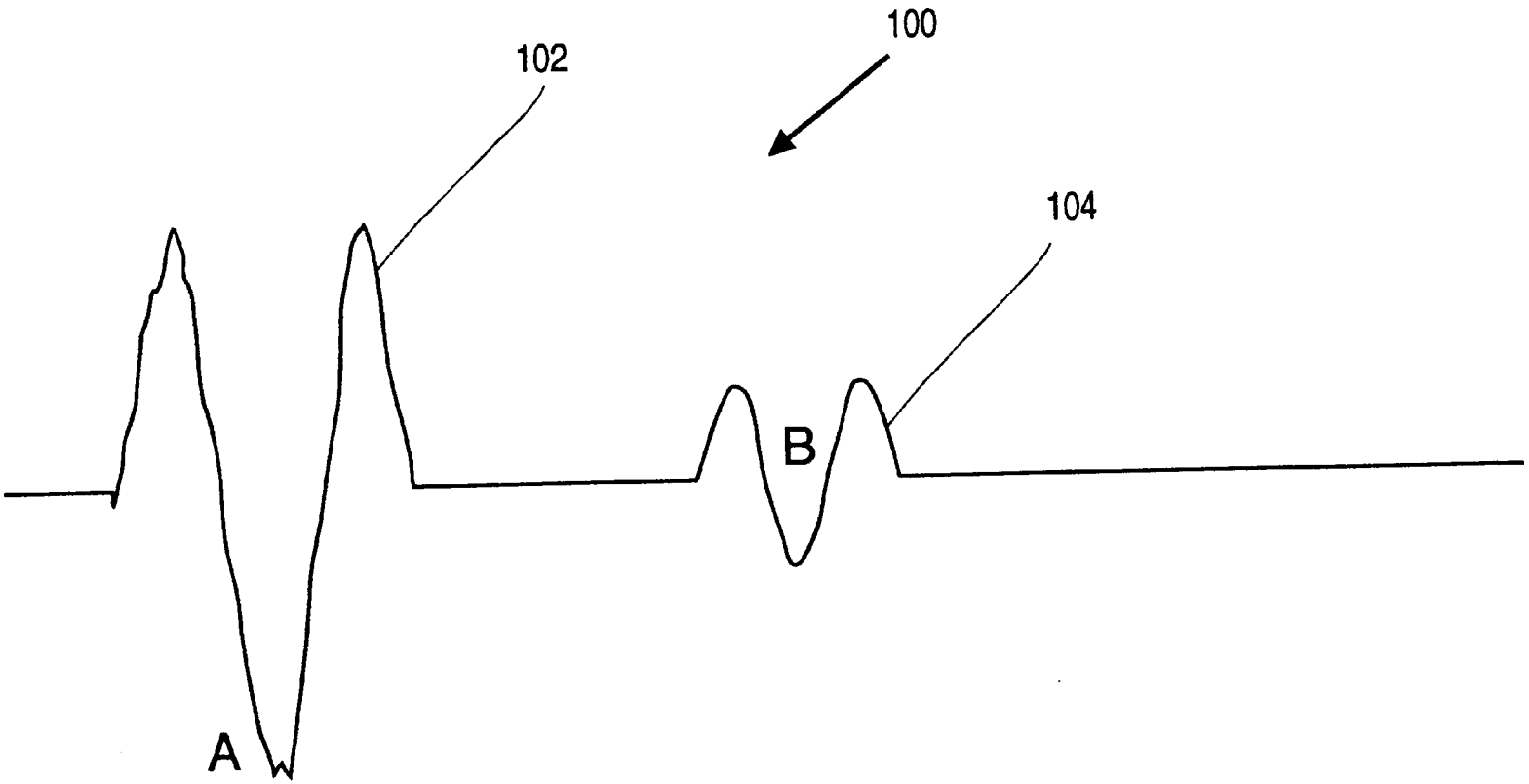
FIG. 8 shows the typical signal produced by a human target in the monitored space and by a animal target in a monitored space.

The signal 100 of FIG. 8 shows the response 102 due to a human intruder in the close zone and response 104 due to a cat in the close zone. The vertical elongation of the active zones has reduced the signal produced by a small pet.

Many beams are used to generally flood the area with vertical height of each beam being much greater than the height of a small pet.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A passive infrared motion sensor for a security system said sensor comprising a single element passive infrared detector, a focussing arrangement in front of said detector for segmented focussing of infrared radiation from an area to be monitored onto said detector and processing circuitry for analyzing the signal from said detector and making a determination whether an intruder is present, said focussing arrangement being divided into at least 3 horizontal tiers comprising an upper distant tier, an intermediate tier and a close tier, and wherein said close tier has a series of horizontally spaced focussing facets, wherein each focussing facet has a detection region and each facet is segmented to vertically elongate and shape the detection region rendering the detection region less responsive to a small pet such that the processing circuitry distinguishes in the same manner between an intruder and a small pet throughout the area to be monitored.

2. A passive infrared motion sensor as claimed in claim 1 wherein each of said tiers includes detection regions which are vertically sized such that a small pet in said region remains distinguishable from an intruder by said processing circuitry.

3. A passive infrared motion sensor as claimed in claim 2 wherein each focussing facet of said close tier has been vertically segmented and shifted to define a stack focal points defining said detection region.

4. A passive infrared motion sensor as claimed in claim 1 wherein said focussing arrangement is a Fresnel lens.

5. A passive infrared motion sensor as claimed in claim 2 wherein said Fresnel focussing arrangement is a Fresnel lens.

6. A passive infrared motion sensor as claimed in claim 3 wherein said Fresnel focussing arrangement is a Fresnel lens.

7. A passive infrared motion sensor as claimed in claim 1 wherein said focussing arrangement is a mirror arrangement.

8. A passive infrared motion sensor as claimed in claim 2 wherein said focussing arrangement is a mirror arrangement.

9. A passive infrared motion sensor as claimed in claim 1 wherein said segmented focussing facets of said close tier define a vertically continuous detection region.

10. A passive infrared motion sensor as claimed in claim 1 wherein each focussing facet of said intermediate tier is divided horizontally into discrete focussing segments stacked one above the other.

11. A passive infrared motion sensor for a security system, said sensor comprising a passive infrared detector, a Fresnel focussing arrangement in front of said detector for segmented focussing of infrared radiation from an area to be monitored onto said detector, and processing circuitry for analyzing the signal from said detector and making a determination whether an intruder is present, said Fresnel focussing arrangement being divided into at least 3 horizontal tiers comprising an upper distant tier, an intermediate tier and a close tier with each tier having a series of horizontally spaced focussing facets, and wherein each focussing facet of said close and intermediate tiers is segmented to define a vertically elongate and narrow a detection region whereby the response for the focussing facets of said close and said intermediate tiers distributed throughout each vertically elongate and narrow detection region, the processing circuitry distinguishes between an intruder and a small pet in a consistent manner.

12. A passive infrared motion sensor for a security system said sensor comprising a passive infrared detector, a Fresnel focussing arrangement in front of said detector for segmented focussing of infrared radiation from an area to be monitored onto said detector and processing circuitry for analyzing the signal from said detector and making a determination whether an intruder is present, said Fresnel focussing arrangement being divided into at least 3 horizontal tiers comprising an upper distant tier, an intermediate tier and a close tier with each tier having a series of horizontally spaced focussing facets, and wherein each focussing facet of said close and intermediate tiers is segmented to vertically elongate and shape a detection region of each facet such that the passive infrared radiation received due to a small pet in the detection region is easily distinguished from passive infrared radiation received due to an intruder in the detection region.

13. A passive infrared radiation sensor as claimed in claim 12 wherein the detection region of each facet is of a narrow width and elongated height.

14. A passive infrared radiation sensor as claimed in claim 13 wherein a small pet in said region associated with said close tier causes said detector to produce a signal less than 80% of the signal used to make the determination an intruder is present.

15. A passive infrared motion sensor for monitoring a region for the presence of an intruder, said sensor comprising a passive infrared detector, a focussing arrangement in front of said detector for selective focussing of infrared radiation from an area to be monitored onto said detector and processing circuitry for analyzing the signal from said detector and making a determination whether an intruder is present, said focussing arrangement being divided into at least 2 tiers comprising a first tier and a second tier, said first tier focussing radiation from a distant subdivision of said monitoring region and said second tier focussing radiation from a close subdivision of said monitoring region, said second tier dividing the close subdivision into narrow elongated vertically disposed sensing strips such that a small pet in said close subdivision causes said detector to produce a signal less than 80% of the signal used to indicate the presence of an intruder in said close subdivision or said distant subdivision and the signal of an intruder from any sensing strip is easily distinguishable from the signal of a small pet from any sensing strip.

16. A passive infrared sensor as claimed in claim 15 wherein a small pet in said close subdivision causes said detector to produce a signal less than 40% of the signal used to indicate the presence of an intruder in said close subdivision or said distant subdivision.

17. A passive infrared sensor as claimed in claim 15 wherein two small pets in said close subdivision fail to cause said detector to produce a signal indicating the presence of an intruder.

* * * * *